United States Patent [19]

Siff et al.

[11] Patent Number: 4,509,675

[45] Date of Patent: Apr. 9, 1985

[54] MAIL BOX

[76] Inventors: Bradford E. Siff; Elliott J. Siff, both of 15 Broadview Rd., Westport, Conn. 06880

[21] Appl. No.: 119,742

[22] Filed: Feb. 8, 1980

[51] Int. Cl.[3] ..... A47G 29/12

[52] U.S. Cl. ..... 232/17; 232/38; 232/39; 232/45

[58] Field of Search ..... 232/17, 38, 39, 45; 248/145, 121, 158; 109/50

[56] References Cited

U.S. PATENT DOCUMENTS

| | | | |
|---|---|---|---|
| 474,676 | 4/1892 | Speer | 232/38 |
| 494,177 | 3/1893 | McManigal | 232/38 |
| 903,362 | 11/1908 | Denny | 232/39 |
| 1,009,235 | 11/1911 | Gidley | 232/45 |
| 1,129,382 | 2/1915 | Delonais | 232/38 |
| 1,194,593 | 8/1916 | Boland | 232/45 |
| 1,359,412 | 11/1920 | Martin | 232/39 |
| 1,480,452 | 1/1924 | Kolstad | 232/17 |
| 1,901,904 | 3/1933 | Ehrlich | 232/39 |
| 3,182,903 | 5/1965 | Marton | 232/45 X |
| 3,735,919 | 5/1973 | Morgan | 232/17 |

OTHER PUBLICATIONS

Sunday Star Pictorial Mag. Dec. 2, 1951, p. 29.

*Primary Examiner*—William E. Lyddane
*Assistant Examiner*—Peter A. Aschenbrenner

[57] ABSTRACT

A roadside mail box formed of an L-shaped tubular member erected with the "L" inverted and having a mail compartment in its horizontal leg. In a preferred embodiment, a closure sleeve, closed at one end, is coaxially, rotatably disposed on the horizontal leg. Respective elongated openings on the side of the horizontal leg and in the sidewall of the sleeve, register at one rotational position of the sleeve to permit access to the mail compartment and, in other rotational positions of the sleeve, are out of registration to close the compartment. Detents establish open and closed positions of the sleeve which is pendulously urged to the closed position. In alternative forms of construction the closure sleeve is absent and a sliding or hinged door closes the opening to the mail compartment.

10 Claims, 8 Drawing Figures

MAIL BOX

BACKGROUND OF THE INVENTION

1. Field of the Invention

This invention relates to domestic mail boxes of the roadside, rural-delivery type.

2. Brief Description of the Prior Art

Mailboxes of the type to which the invention pertains are of a more or less standard design and have remained substantially unchanged for many decades. Typically, they consist of a sheet metal box with a rounded top and a flap-type door at one end swinging on a horizontal hinge at the lower edge of the box. While some highly innovative and imaginative ways are occasionally employed to install the box at roadside, this is normally done by mounting the box on a horizontal arm fastened to a post having one end embedded in the ground. The arm projects outwardly toward the road and the box is installed with the door facing the road to allow easy access thereto by the carrier.

The present design of rural delivery mail boxes has served its purpose well but, in recent years, the flimsy construction and the type of mounting employed have made them an attractive target for vandalism: they are no match for a club-wielding youth leaning out of a car window who derives some perverse pleasure in demolishing them.

The primary object of the present invention is to provide a novel rural delivery type mail box of an improved design that lends itself to a ruggedized construction which resists damage, intentional or accidental, while retaining the advantages of the standard existing type box.

A further object of the invention is to provide an improved rural delivery type mailbox which is integrated with its support post and is easily opened and closed.

A still further object is the provision of a rural delivery type mail box which is durable, damage-resistant and lends itself to easy manufacture.

BRIEF DESCRIPTION OF THE INVENTION

The invention contemplates a roadside mail receptacle comprising a hollow member of L-shaped configuration, at least the horizontal leg of which is of substantially circular cross-section. A transverse partition in the horizontal leg remote from the free end thereof defines a mail compartment therein. An opening in the horizontal leg permits insertion and removal of mail into and from the compartment. In a preferred embodiment, a cylindrical closure sleeve, closed at one end, is coaxially and rotatably disposed on the horizontal leg and has a sidewall opening which, in one rotational position of the sleeve, registers with the opening in the horizontal leg. Preferably, means are provided to bias the sleeve to a position in which the respective openings are out of registration and detents define the two positions. In alternative embodiments, a sliding-or hinged door replaces the rotatable sleeve as a closure for the mail compartment.

DESCRIPTION OF A PREFERRED EMBODIMENT

Figure 1:
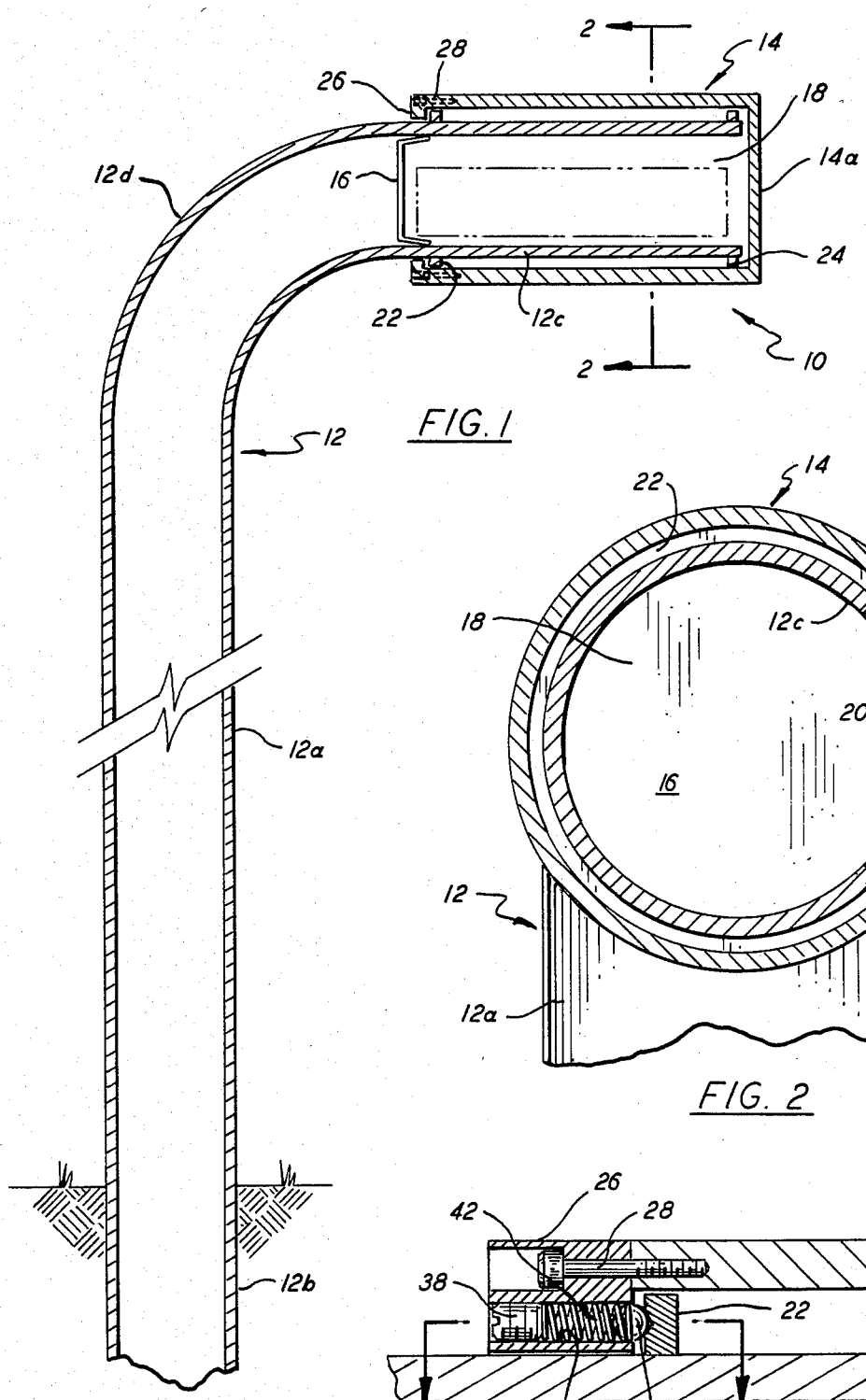
FIG. 1 is an axial-sectional view of a mail receptacle in accordance with the present invention, shown as it would be installed at a roadside location.
Figure 2:
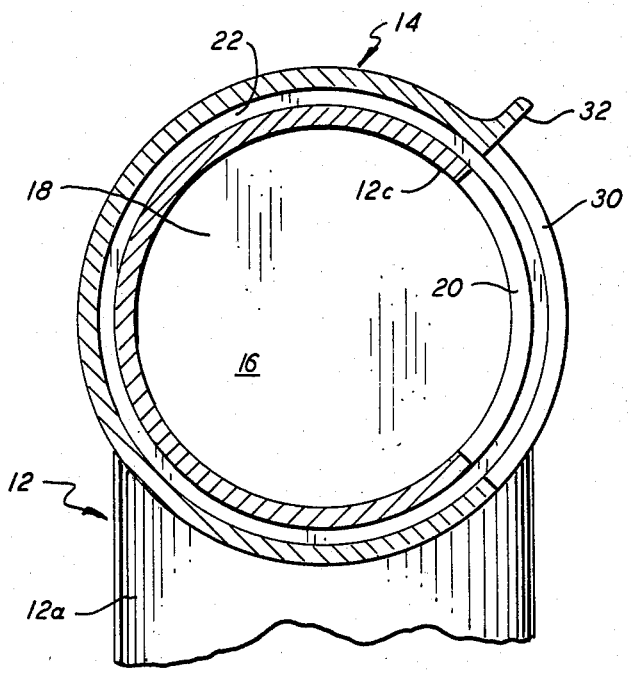
FIG. 2 is a cross-sectional view taken on line 2—2 of FIG. 1 looking in the direction of the arrows.

Referring now to the drawings and first in particular to FIGS. 1 and 2, there is shown a rural delivery type mail receptacle unit designated in its entirety by reference numeral 10. The unit consists of two principal components, an L-shaped section 12 of metal tubing, high impact plastic or the like, and a closure sleeve member 14 of a hollow cylindrical configuration, closed at one end 14*a*.

L-shaped section 12 is shown in an inverted attitude, i.e., with the vertical leg 12*a* extending downwardly, the terminal portion 12*b* being embedded in the earth at a suitable roadside location, with the horizontal leg 12*c* directed toward the road. Preferably, the terminal portion 12*b* of the vertical leg extends below the frost line and is embedded in concrete. For ease of manufacture and to avoid stress concentrations, the junction between the horizontal and vertical legs of section 12 preferably takes the form of a fairly large radius bend 12*d*.

Within horizontal leg 12*c*, at a location remote from the free end thereof, is a transverse partition member 16 which defines a mail compartment 18. Member 16 may be welded or shrink-or press-fitted into the horizontal leg 12*c*.

Running substantially the length of mail compartment 18 is an elongate opening 20 in the sidewall of horizontal leg 12*c* to permit the insertion and removal of mail into and out of the mail compartment. In cross-section (FIG. 2), opening 20 preferably subtends an angle of about 90° (±45° above and below horizontal) and lies generally in a plane parallel to that defined by the axes of legs 12*a* and 12*c* of the L-shaped section. The plane of opening 20 is of course essentially vertical when the unit is installed at roadside.

Sleeve 14 telescopically receives and is rotatably mounted on horizontal leg 12*c*. To this end, a pair of annular bearing members 22, 24 are provided at axially spaced locations on the exterior of horizontal leg 12*c*. Bearing members 22, 24 may be simple metal rings shrink-fitted on the horizontal leg or may be made of special low friction material such as Teflon. For even greater anti-friction effect, roller- or ball-bearings may be employed. The inner bearing member (22), i.e., that farthest from the free end of horizontal leg 12*c*, serves as a retainer, coacting with an annular flange 26 secured to the open (inner) end of closure sleeve 14, as by screws 28, to prevent axial displacement of the sleeve to the right as shown in FIG. 1. A slot-like opening 30 of the same general size and configuration as opening 20 in horizontal leg 12*c* is provided in closure sleeve 14. Thus, in a given rotational position of sleeve 14, its opening 30 registers with the opening 20 in horizontal leg 12*c* permitting mail to be inserted into or removed from the mail compartment 18.

Preferably, sleeve 14 is mechanically biased to a rotational position in which openings 20 and 30 are out of registration so that the mail compartment is normally closed. This biasing may be accomplished by making the sleeve pendulous as, for example, by weighting the sleeve in the region of opening 30 by means of a suitable protuberance such as that shown at 32 in FIG. 2. In a preferred embodiment, protuberance 32 takes the form of a channel-shaped rib extending along the length, parallel to and, with the sleeve 14 in the position shown in FIG. 3 immediately above slot 30. Thus formed and located, protuberance 32 serves to prevent rain from running into slot 30 and also provides a conventient grip for rotating the sleeve.

A detent mechanism, to be described presently, may be provided to define, and releasably maintain sleeve 14 in the open position, i.e., with slots 20 and 30 in registration, as shown in FIG. 2, as well as a closed position in which the slots are out of registration. The closed position detent can, of course, be omitted, in which case the closed position would be defined by gravity, the sleeve assuming a position rotated at least approximately 90 degrees clockwise from that shown in FIG. 2, due to the pendulosity imparted by protuberance 32.

Figure 3:
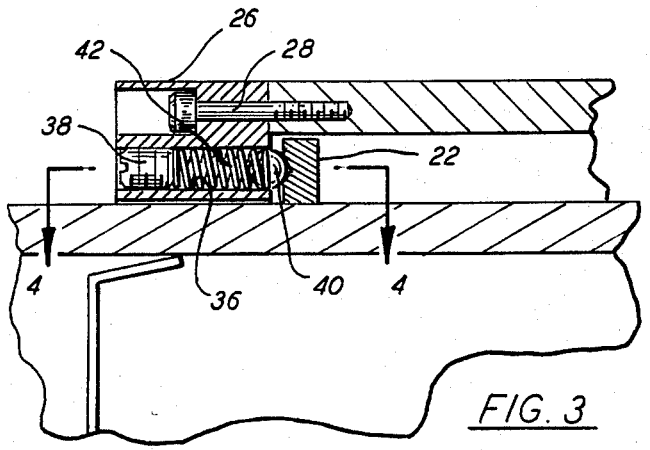
FIG. 3 is an enlargement of a portion of FIG. 1 showing additional details.

As the detent mechanism can be identical for both open and closed positions, a single example is shown in the enlarged fragmentary view consituting FIG. 3., which is a portion of mail compartment 18 adjacent partition member 16 and showing a detent operative between flange 26 and bearing/retainer 22.

Figure 4:
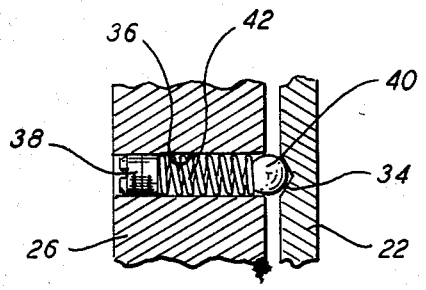
FIG. 4 is a fragmentary sectional view on line 4—4 of FIG. 3 looking in the direction of the arrows.

As appears in FIGS. 3 and 4, bearing/retainer member 22 is provided, in its radial surface confronting flange 28, with a recess 34 formed, for example, by a v-shaped notch. Flange 26 contains a bore 36 open at its one end opposite member 22 and closed at its other end by a screw 38. Bore 36 contains a detent ball 40 urged toward member 22 by means of a coil spring 42 compressed between the ball and screw 38. When recess 34 is opposite bore 36 due to the rotational position of sleeve 14 relative to horizontal leg 12*c*, ball 40 enters the recess establishing and releasably maintaining the sleeve position. It is, of course, to be understood that the angular location of bore 36 and recess 34 are selected with respect to openings 20 and 30 so as to secure the appropriate open and closed position of the sleeve. Multiple detents can be used for each position, if desired.

The operation of the mail receptacle is deemed to be self-evident from the preceding description: the normal closed position of the mail receptacle is with openings 20 and 30 out of registration. In the preferred embodiment described, the closed position would be with sleeve 14 rotated 90 degrees clockwise from the position shown in FIG. 2. To gain access to the interior of compartment 18, sleeve 14 is rotated counter-clockwise 90 degrees so that the openings 20 and 30 are in registration at which time the open position detent engages to hold the sleeve while mail is being inserted into or removed from compartment 18. Then a slight clockwise movement of the sleeve disengages the detent and the sleeve automatically returns to its closed position.

Figure 6:
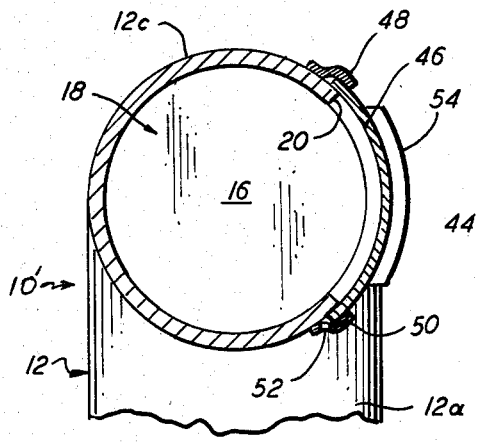
FIG. 6 is a cross-sectional view on line 6—6 of FIG. 5 looking in the direction of the arrows.
Figure 5:
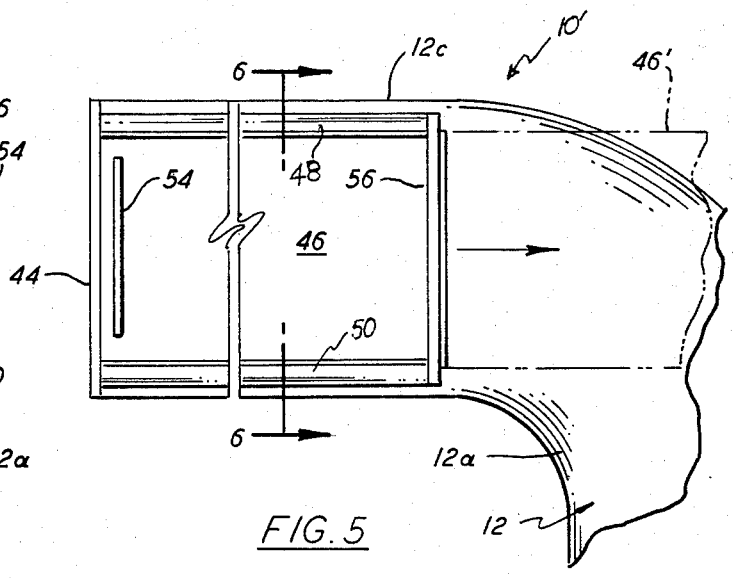
FIG. 5 is a partial side elevational view of an alternative embodiment of the invention.

An alternative embodiment of the invention is shown in FIGS. 5 and 6 in which parts in common with FIGS. 1–4 bear the same reference characters. As in the first-described embodiment, the principal structural element of the receptacle unit 10' is L-shaped section 12 of metal or high impact plastic tubing containing a transverse partition 16 defining in the horizontal leg 12*c* a mail compartment 18. The free end of leg 12*c* is closed by means of a plate 44 welded or otherwise secured thereto. The mail access opening 20 is closed by means of a longitudinally displaceable closure member 46 slidably mounted in guide members 48 and 50 extending along the upper and lower edges of the opening. As evident from FIG. 6, closure member 46 is curved in a vertical plane to conform to the curvature of tubular section 12. The upper guide member (48) shields against the entry of rain and drain holes (one shown at 52) are provided for rain entering the lower channel (50).

In the illustrated embodiment, closure member 46 is arranged to slide rearwardly, i.e., away from the free end of leg 12*c*, to the dotted line position 46' to uncover the access opening 20. To facilitate opening and closing, a handle 54 is provided at the front edge of closure member 46 and engages a stop bar 56 bridging guide members 48 and 50 at their respective rearward ends, thus limiting the travel of the closure member.

Figure 7:
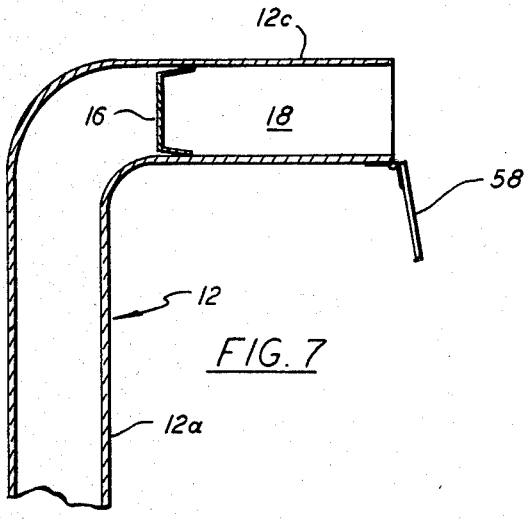
FIG. 7 is a partial axial section of still another alternative embodiment of the invention.
Figure 8:
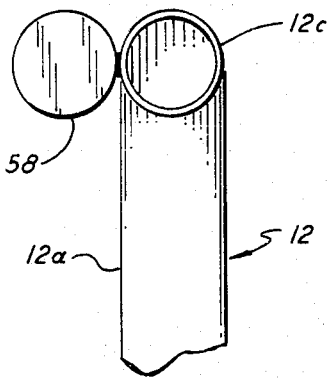
FIG. 8 is a partial front elevational view of a modified form of the FIG. 7 embodiment.

Respective further modifications of the invention are shown in FIGS. 7 and 8 wherein parts in common with the previously discussed figures are designated with the same reference characters. In these embodiments, the side access opening 20 common to the previously-described configurations is omitted and the free end of horizontal leg 12*c* left open. Closure of the opening is accomplished by means of a swinging closure member 58 which may be hinged to the free end of the horizontal leg 12*c* at the bottom as shown in FIG. 7 or the side as shown in FIG. 8.

The operation of the embodiments shown in FIGS. 5–8, inclusive, is self-evident from the foregoing description and the referenced drawings.

Other modifications of the present invention are possible in light of the above description which should not be construed as limiting the invention beyond those limitations set forth in the claims which follow.

What is claimed is:

1. A roadside mail receptacle of the rural delivery type, comprising:

a hollow member of L-shaped configuration, at least the horizontal leg of the L-shape being of substantially circular cross-section;

a transverse partition in said horizontal leg remote from the free end thereof and defining therein a mail compartment;

means defining an opening in the horizontal leg for the insertion and removal of mail into and from said compartment; and a cylindrical closure sleeve, closed at one end, coaxially rotatably disposed on said horizontal leg and having a sidewall opening adapted, in one rotational position of the sleeve, to register with the opening in said horizontal leg.

2. A mail receptacle according to claim 1, including means to bias said sleeve to a rotational position in which said openings are out of registration.

3. A mail receptacle according to claim 2, wherein the opening in said horizontal leg is in a plane generally parallel to that defined by the axes of the legs of said L-shape and said sleeve is biased to a position in which the opening therein is in a plane generally perpendicular to the vertical leg of said L-shape.

4. A mail receptacle according to claim 3 including detent means defining and releasably maintaining said sleeve in, a second rotational position in which said openings are in registration.

5. A mail receptacle according to claim 4, wherein said hollow member consists of a unitary section of thick-walled tubing.

6. A roadside mail receptacle of the rural delivery type, comprising:

a unitary L-shaped section of thick-walled tubing adapted to have the free end of the longer, vertical leg of the section fixed to the ground at roadside so that the L-shape is supported in an inverted attitude with the horizontal leg projecting toward the road;

a transverse partition fixed in said horizontal leg at a location remote from the free end thereof to define a mail compartment therein;

means defining a horizontal slot in one side of said horizontal leg for the insertion and removal of mail into and from said compartment;

an annular bearing member on the external surface of said horizontal leg adjacent the free end thereof;

a second annular bearing member on the external surface of said horizontal leg spaced inwardly from said first bearing member;

a cylindrical closure sleeve closed at one end coaxially disposed on said horizontal leg and rotatable on said bearing members;

an inwardly projecting annular flange on the open end of said sleeve engaging said second bearing member to retain said sleeve against axial displacement from said horizontal leg; and means defining a longitudinal slot in said sleeve adapted in one rotational position of the sleeve to register with the slot in said horizontal leg.

7. A mail receptacle according to claim 6, wherein the sleeve is weighted so as to inherently assume a first position in which said slots are out of registration.

8. A mail receptacle according to claim 7, including detent means between said flange and second bearing member defining, and operative to retain said sleeve in, a second rotational position in which said slots are in registration.

9. A mail receptacle according to claim 8, including detent means between said flange and second bearing member defining, and operative to retain said sleeve in, said first rotational position.

10. A roadside mail receptacle of the rural delivery type, comprising:

a unitary L-shaped section of thick-walled tubing adapted to have the free end of the longer, vertical leg of the section fixed to the ground at roadwide so that the L-shape is supported in an inverted attitude with the horizontal leg projecting toward the road;

a transverse partition fixed in said horizontal leg at a location remote from the free end thereof to define a mail compartment therein;

means defining an opening in the sidewall of the horizontal leg for the insertion and removal of mail into and from said compartment; and a displaceable closure member for said opening mounted for sliding movement parallel to the axis of said horizontal leg.

* * * * *